US009783358B2

(12) United States Patent
Dhand

(10) Patent No.: US 9,783,358 B2
(45) Date of Patent: Oct. 10, 2017

(54) SEGMENTED YOGURT CONTAINER

(71) Applicant: Rajiv Dhand, Knoxville, TN (US)

(72) Inventor: Rajiv Dhand, Knoxville, TN (US)

( * ) Notice: Subject to any disclaimer, the term of this patent is extended or adjusted under 35 U.S.C. 154(b) by 3 days.

(21) Appl. No.: 14/989,879

(22) Filed: Jan. 7, 2016

(65) Prior Publication Data

US 2016/0200499 A1 Jul. 14, 2016

Related U.S. Application Data

(60) Provisional application No. 62/101,062, filed on Jan. 8, 2015.

(51) Int. Cl.
*B65D 1/24* (2006.01)
*B65D 81/32* (2006.01)
*B65D 85/72* (2006.01)

(52) U.S. Cl.
CPC ..... *B65D 81/3222* (2013.01); *B65D 85/72* (2013.01)

(58) Field of Classification Search
CPC .... B65D 81/3222; B65D 25/08; B65D 51/28; B65D 81/3216; Y10S 215/08
USPC ..... 220/533
See application file for complete search history.

(56) References Cited

U.S. PATENT DOCUMENTS 4,362,750 A 12/1982 Swartz
4,793,476 A * 12/1988 Schrupp ..... B65D 81/3222 206/222
5,096,084 A 3/1992 Wells
5,676,244 A 10/1997 Green
5,871,116 A 2/1999 Picchietti
5,908,649 A 6/1999 Floyd
6,257,403 B1 7/2001 Feldmeier
6,269,964 B1 8/2001 Turner
6,403,144 B1 6/2002 El-Khoury et al.
6,534,102 B2 3/2003 Kazemzadeh
6,723,360 B1 4/2004 Dunaway
6,777,017 B2 8/2004 Porter et al.
6,800,307 B1 10/2004 Matthews et al.
6,955,028 B1 10/2005 Dunaway
7,041,326 B2 5/2006 Bradley
7,063,229 B2 6/2006 Westerhof
7,669,714 B1 3/2010 Grossman
8,003,053 B2 * 8/2011 Senftner ..... B01L 3/08 206/730

(Continued)

FOREIGN PATENT DOCUMENTS

EP 500318 8/1992
EP 1831085 12/2011

(Continued)

*Primary Examiner* — Shawn M Braden
(74) *Attorney, Agent, or Firm* — Pitts & Lake, P.C.

(57) ABSTRACT

A segmented food product container for segregating a secondary food product from a primary food product before the segmented food product container is opened and the two ingredients mixed together prior to consumption. The segmented container includes a primary container, defined by cup member, and a secondary container defined by a cylinder having two open ends, at least one end of which is internally threaded. An externally threaded boss is disposed on, or carried by, the base of cup member. When the cylinder is threaded onto threaded boss, the cylinder can then receive the secondary food ingredient. Further, a lid member seals both the cup member and cylinder.

11 Claims, 10 Drawing Sheets

(56) References Cited

U.S. PATENT DOCUMENTS

| | | | | |
|---|---|---|---|---|
| 8,083,056 | B1 * | 12/2011 | Wu | B65D 25/08 206/221 |
| 8,409,645 | B2 | 4/2013 | Feldmeier | |
| 8,455,019 | B2 | 6/2013 | Milo et al. | |
| 8,541,038 | B2 | 9/2013 | Feldmeier | |
| 8,551,545 | B2 | 10/2013 | Feldmeier | |
| 8,753,699 | B2 | 6/2014 | Roberts | |
| 8,784,917 | B2 | 7/2014 | Sebban | |
| 8,802,182 | B2 | 8/2014 | Julien et al. | |
| 8,807,373 | B1 | 8/2014 | Russell | |
| 8,815,956 | B2 | 8/2014 | Tachdjian et al. | |
| 8,828,472 | B2 | 9/2014 | Martinsen | |
| 8,840,946 | B2 | 9/2014 | Fleury Rey | |
| 9,545,607 | B1 * | 1/2017 | Thompson | B01F 13/0022 |
| 2006/0068063 | A1 | 3/2006 | Zerfas | |
| 2006/0180483 | A1 | 8/2006 | Sekendur | |
| 2006/0191805 | A1 | 8/2006 | Vogel | |
| 2006/0272964 | A1 | 12/2006 | Vogel | |
| 2007/0125777 | A1 | 6/2007 | Massop | |
| 2007/0227919 | A1 | 10/2007 | True | |
| 2009/0211927 | A1 * | 8/2009 | Wu | B65D 81/3222 206/219 |
| 2009/0311389 | A1 | 12/2009 | Zoss | |
| 2010/0003379 | A1 | 1/2010 | Zoss | |
| 2010/0112146 | A1 | 5/2010 | Zoss | |
| 2010/0116698 | A1 | 5/2010 | Sudhakar | |
| 2011/0303678 | A1 | 12/2011 | Zomorodi | |
| 2012/0201945 | A1 | 8/2012 | Iwahata et al. | |
| 2012/0258213 | A1 | 10/2012 | Sharma | |
| 2013/0026124 | A1 * | 1/2013 | Wu | B65D 81/3222 215/6 |
| 2014/0025508 | A1 | 1/2014 | Bartosch | |
| 2014/0097106 | A1 | 4/2014 | Broekaert | |
| 2014/0183090 | A1 | 7/2014 | Manion | |
| 2014/0183190 | A1 | 7/2014 | Tyberghein | |
| 2014/0242255 | A1 | 8/2014 | Jia et al. | |

FOREIGN PATENT DOCUMENTS

| | | |
|---|---|---|
| FR | 2553386 | 4/1985 |
| WO | WO2014107575 | 7/2014 |

* cited by examiner

SEGMENTED YOGURT CONTAINER

CROSS-REFERENCE TO RELATED APPLICATIONS

This application claims the benefit of U.S. Provisional Patent Application No. 62/101,062, filed on Jan. 8, 2015, which is incorporated herein in its entirety by reference.

STATEMENT REGARDING FEDERALLY SPONSORED RESEARCH OR DEVELOPMENT

Not Applicable

BACKGROUND OF THE INVENTION

1. Field of Invention

The invention relates to a food product container. More particularly, it relates to a multi-compartment segmented container adapted for a food product, including but not limited to yogurt, in which a secondary container holds spices or other ingredients to be mixed with the primary food product, such as yogurt, prior to consumption.

2. Description of the Related Art

In the art of food containers, including yogurt containers, it is known to provide compartmentalized containers for segregating different ingredients of a food item until such time as the food item is to be consumed, immediately prior to which the different ingredients are mixed. For instance, fast-food chain, McDonalds®, famously advertised that its sandwich, the McDLT, was packaged in a novel, two-sided, container that kept the hot items hot and the cold items cold; this package was disclosed in U.S. Pat. No. 4,653,685 issued to Leary et al. on Mar. 31, 1987. U.S. Pat. No. 5,871,116 issued to Picchietti on Feb. 16, 1999, discloses a food container formed of a pair of matched upper and lower dishes having a perforate interconnecting member disposed between the upper and lower dishes. U.S. Pat. No. 6,955,028 issued to Dunaway on Oct. 18, 2005, discloses a method of forming a multiple food product container for dispensing different food products from different regions of the container, i.e. one food product could be dispensed from the bottom of the container while a second food product could be dispensed from the top of the container. U.S. Pat. No. 7,063,229 issued to Westerhof et al. on Jun. 20, 2006, discloses a single handed container for mixing foods, such as milk and cereal. U.S. Patent Appln. No. 2006/0272964, filed by Vogel et al. and published on Dec. 7, 2006, discloses a closure system for food containers and a method for mixing food items stored in separate portions of such a food container. And, U.S. Patent Appln. No. 2014/0097106 filed by Broekaert et al. and published on Apr. 10, 2014, discloses a container for packaging and storing in separate compartments at least two products which need to be combined to prepare a ready-to-use product. Other known references include U.S. Pat. No. 8,807,373; U.S. Pat. No. 8,784,917; U.S. Pat. No. 8,753,699; U.S. Pat. No. 8,551,545; U.S. Pat. No. 8,541,038; U.S. Pat. No. 8,409,645; U.S. Pat. No. 7,669,714; U.S. Pat. No. 7,041,362; U.S. Pat. No. 6,723,360; U.S. Pat. No. 6,269,964; U.S. Pat. No. 6,257,403; U.S. Pat. No. 5,908,649; U.S. Pat. No. 5,676,244; U.S. Pat. No. 5,096,084; U.S. Pat. App. No. 2014/0183190A1; U.S. Pat. App. No. 2014/0183090A1; U.S. App. No. 2014/0097106A1; U.S. Pat. App. No. 20100112146A1; U.S. Pat. App. No. 20100116698A1; U.S. Patent App. No. 20100003379A1; U.S. Pat. App. No. 20090311389A1; U.S. Pat. App. No. 20070227919A1; U.S. Pat. App. No. 20060272964A1; U.S. Pat. App. No. 20060191805A1; U.S. Pat. App. No. 20060180483A1; U.S. Pat. App. No. 20060068063A1; U.S. Pat. App. No. 20110303678A1; U.S. Patent App. No. 20070125777A1; U.S. Pat. App. No. 20120258213A1; U.S. Patent App. No. 20140025508A1; Foreign Pat. Document No. EP1831085B1; Foreign Patent Document No. WO2014107575A1; Foreign Patent Document No. EP500318A1; and Foreign Patent Document No. FR2553386A1.

What is missing from the art is a segmented food container, such as a yogurt container, that has a secondary container, for receiving a secondary food item, adapted to be received within, and releasably secured to the primary food container such that, as the secondary food container is removed from within the primary food container, the food product contained within the secondary food container is released into the primary food container where it can be mixed with the primary food product in the primary food container.

BRIEF SUMMARY OF THE INVENTION

The segmented food product container of the present general inventive concept is adapted to segregate a secondary food product, such as a flavor enhancing ingredient, from a primary food product, such as yogurt, before the segmented food product container is opened and the two ingredients mixed together prior to consumption. The segmented container includes a primary container, defined by cup member having a boss member disposed on, or carried by, the base of the cup member. A secondary container defined by a cylinder having two open ends, at least one end of which is adapted to be releasably received by and secured to the boss member. In an exemplary embodiment, the boss member and the secondary container are adapted to be threadably secured to one another. In a further exemplary embodiment, the boss member has an annular ridge member and the end of the secondary container is adapted with a plurality of annular detents that releasably secure the secondary container to the boss member by means of a force fit. When the cylinder is secured to the boss member, the cylinder can then receive the secondary food ingredient. Further, a lid member seals both the cup member and cylinder. In a further embodiment, a snap lid is provided to seal the secondary container member.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 2:
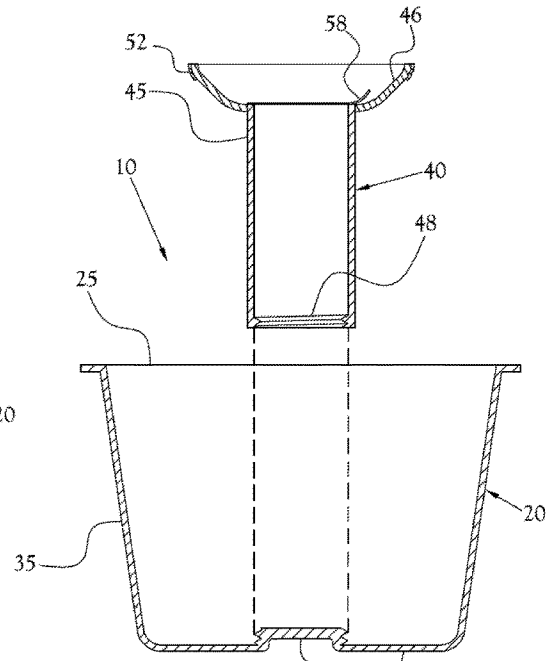
FIG. 2 is an exploded cross-sectional view of the exemplary embodiment segmented yogurt container illustrated in FIG. 1.
Figure 1:
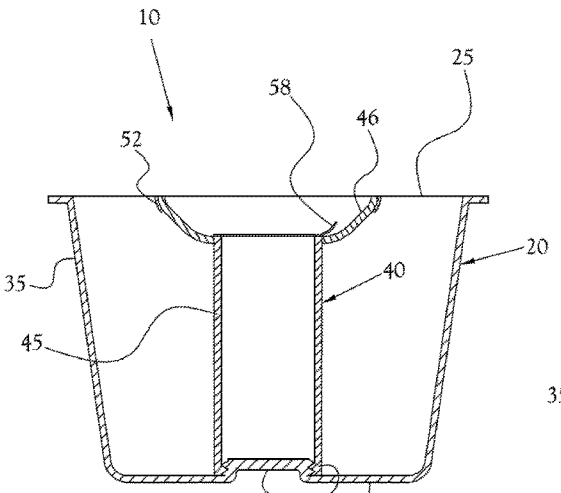
FIG. 1 is a cross-sectional view of the segmented yogurt container of the present general inventive concept.

FIGS. 1-5 illustrate a segmented yogurt container 10. With reference to FIGS. 1 and 2, the segmented food container 10, according to one exemplary embodiment, includes a primary food container defined by a cup member 20 having an open top 25, a closed base 30, and at least one wall member 35 extending upwardly from the closed base 30. Cup member 20, according to one exemplary embodiment, is adapted to contain a food product, such as yogurt, without leaking. The cup member 20 as illustrated in FIGS. 1-5, is depicted as having a circular horizontal cross-section. However, those skilled in the art will appreciate that cup member 20 could have an oval, square, rectangular, or other shaped horizontal cross-section. The present invention is not in any manner deemed to be limited to this shape or any particular dimension. Further, according to one exemplary embodiment of the present general inventive concept cup member 20 has an inverted frusto-conical shape.

Segmented food container 10 is described herein, in accordance with one exemplary embodiment, as a yogurt container designed to contain yogurt in the primary container and an additional flavor enhancing ingredient in a secondary container disposed within the primary container. Flavor enhancing ingredients, such as spices, cardamom, cinnamon, nutmeg, black pepper, red pepper, habanero pepper, various varieties of chili peppers, coconut, cumin, cilantro, coriander, paprika, onion, tamarind, thyme, turmeric, ginger, fennel, mustard, mint, cloves, dates, capsicum, chives, curry leaves, garlic, anise, asafoetida, dill, gourd, and/or squash, are described in greater detail in my co-pending application, Ser. No. 14/886,702, filed on Oct. 19, 2015, entitled Bacterially Fermented, Dairy-Based, Semi-Solid Food Composition and Method for Making the Same which is incorporated herein by reference. Those skilled in the art will recognize and appreciate that segmented container 10 could be used to contain a variety of food products that are designed to be mixed with a secondary ingredient prior to consumption of the food product.

Figure 3:
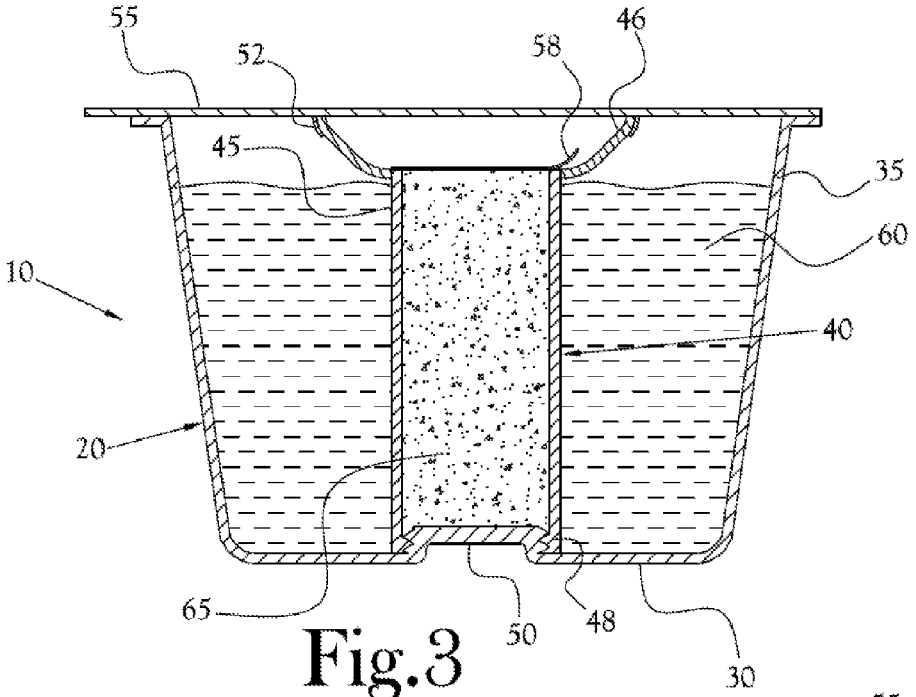
FIG. 3 is a cross-sectional view of the exemplary embodiment segmented yogurt container illustrated in FIG. 1 with yogurt and a spice mixture contained therein.
Figure 4:
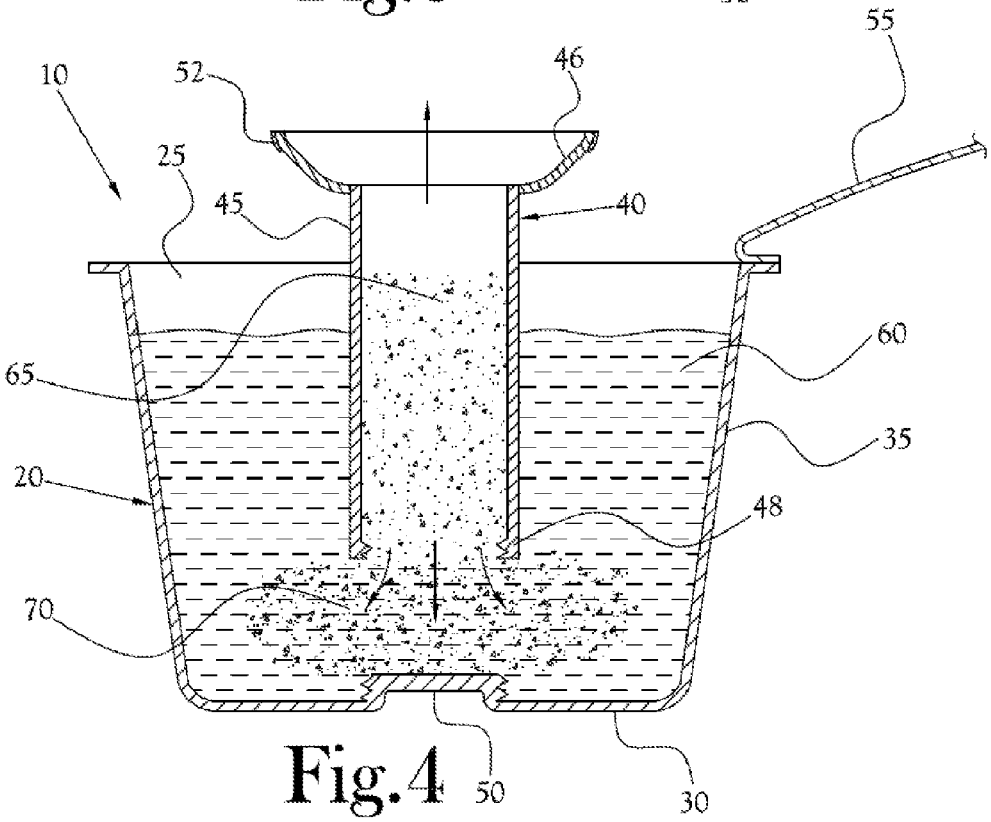
FIG. 4 is a cross-sectional view of the segmented yogurt container illustrated in FIG. 3 showing the spice containing cylinder being removed so as to release the spices into the yogurt.
Figure 5:
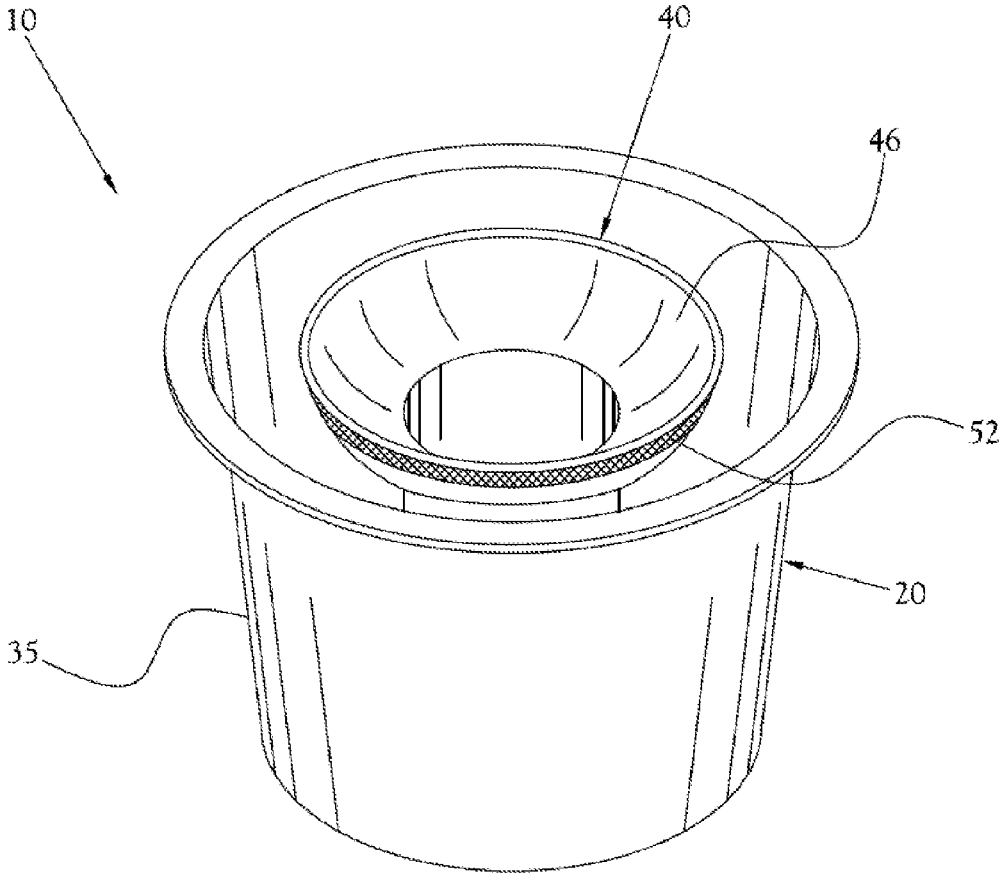
FIG. 5 is a perspective view of the segmented yogurt container illustrated in FIG. 1.

Generally speaking, the segmented food container 10 includes a primary container, defined by cup member 20, as described above, and a secondary container 40. In this regard, in the exemplary embodiment, cup member 20, as the primary container, contains the yogurt 60, while a secondary food product 65, such as spice or other flavor enhancing ingredient to be mixed with the yogurt prior to consumption, is contained within the secondary container 40. As illustrated in FIGS. 3 and 4, while the segmented yogurt container is unopened, the primary container, i.e. cup member 20 and the secondary container 40 are each sealed by a lid member 55 such that the yogurt 60 and the secondary food product 65 are separated and are prevented from mixing. Upon removal of the secondary container 40, the yogurt 60 and the secondary food product 65 mix together to form the mixed food product 70. It will be appreciated by those skilled in the art, that upon removal of the secondary container 40, some manual mixing of the primary and secondary ingredients, as by a spoon, may be necessary depending upon the viscosity and density of the various ingredients.

In accordance with one exemplary embodiment, a boss 50 is disposed on, or carried by, the base 30 of cup member 20. A secondary container 40 is defined by a cylinder 45 having two open ends, at least one end of which is adapted to be received by and releasably secured to boss member 50. In this regard, in one exemplary embodiment, secondary container 40 has a lower end which is internally threaded, defining a threaded end 48. According to an exemplary embodiment, the upper end 46 of secondary container 40 is flared and defines a funnel member. In this exemplary embodiment, boss 50 includes external threads so as to threadably engage the threaded end 48 of the secondary container 40. When cylinder 45 is threaded onto threaded boss 50, boss 50 substantially seals the threaded end 48 of cylinder 45 such that cylinder 45 can then receive the secondary food product 65. FIG. 1 illustrates cylinder 45 threaded onto threaded boss 50 in a condition ready to receive the primary and secondary food items. FIG. 3 illustrates cylinder 45 threaded onto boss 50, with yogurt 60 contained within cup member 20, and a secondary food product 65, such as spices contained within cylinder 45. Further, lid member 55 has sealed both cup member 20 and cylinder 45. In FIG. 4, the lid member 55 has been pulled back, cylinder 45 has been unthreaded from boss 50 and partially removed, allowing the secondary food product 65 to mix with the yogurt 60. In an exemplary embodiment, the outer surface of upper end 46 is knurled 52, or otherwise textured to assist with gripping the upper end 46. Further, an optional seal member 58 could be provided within the secondary container 40 to further segment, or segregate, the interior volume of cylinder 45 from upper end 46. In a further embodiment, a lid member 280, which will be described in greater detail below, is used to seal the upper end of secondary container 40. The flared upper end 46 defines a funnel member and allows the consumer to readily add a third food ingredient, if desired, during the mixing process described herein.

Figure 6:
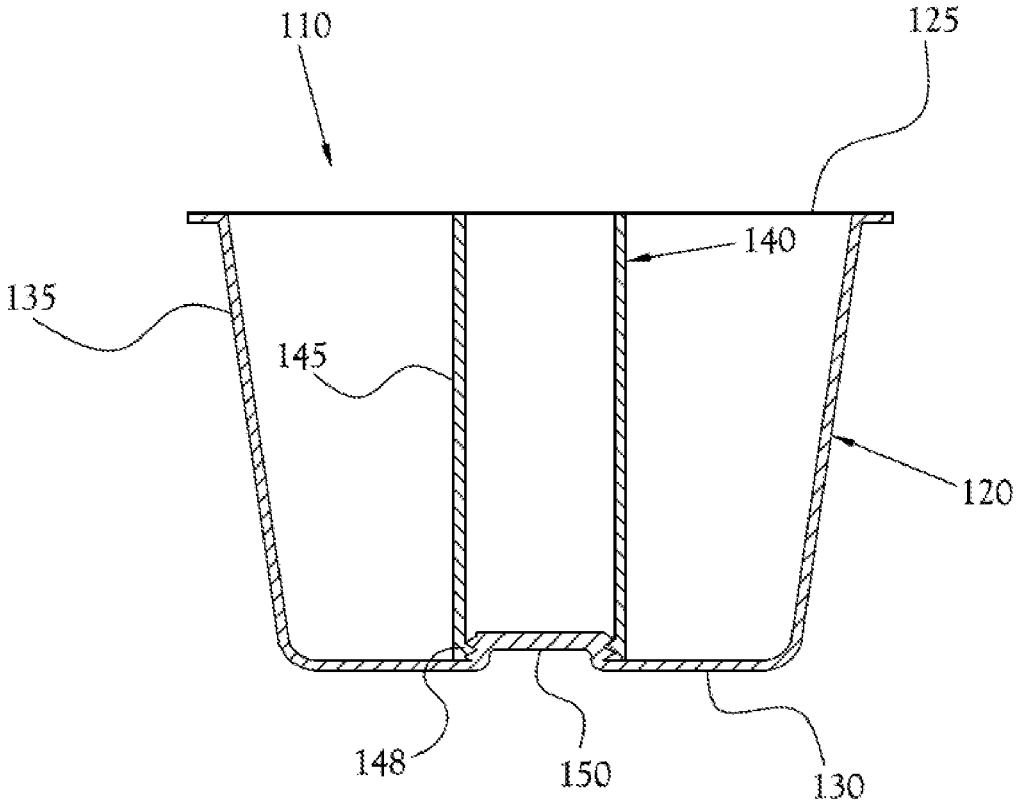
FIG. 6 is a cross-sectional view of another exemplary embodiment of the segmented yogurt container of the present general inventive concept.
Figure 7:
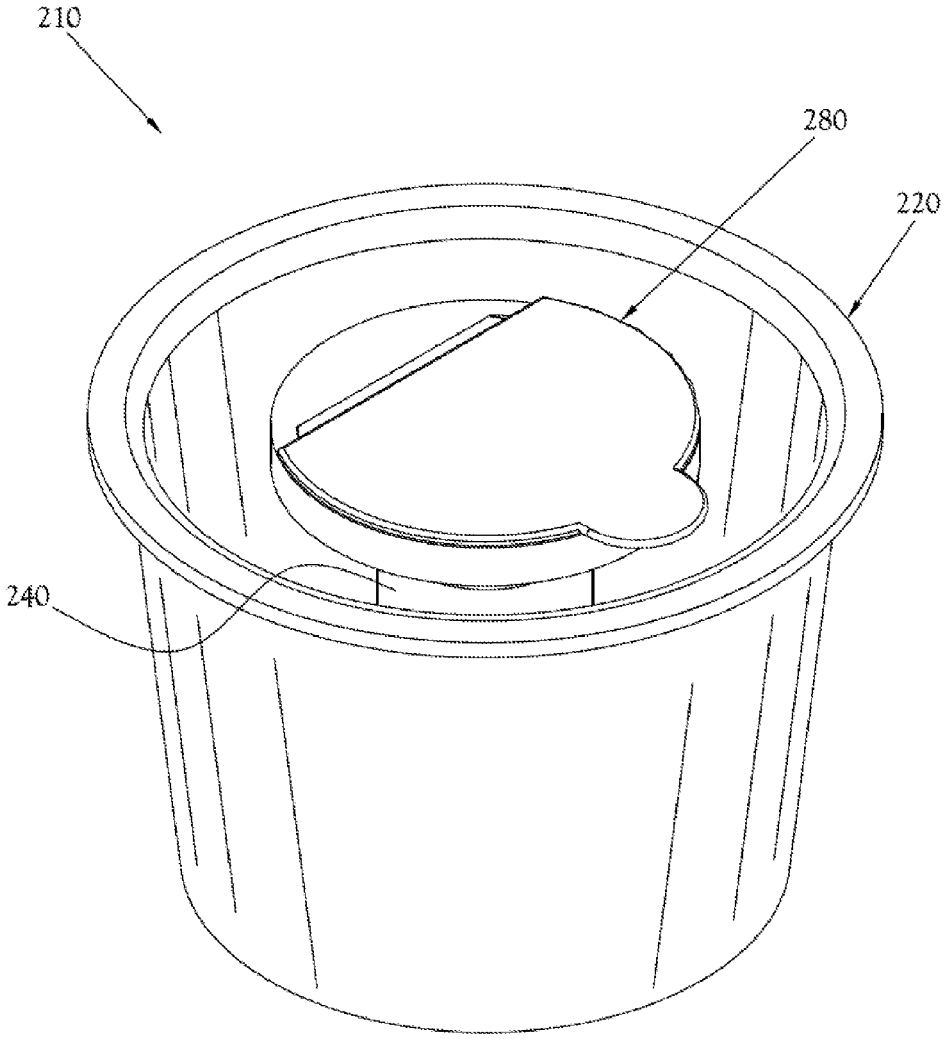
FIG. 7 is a perspective view of a further exemplary embodiment of the segmented yogurt container of the present invention.
Figure 8:
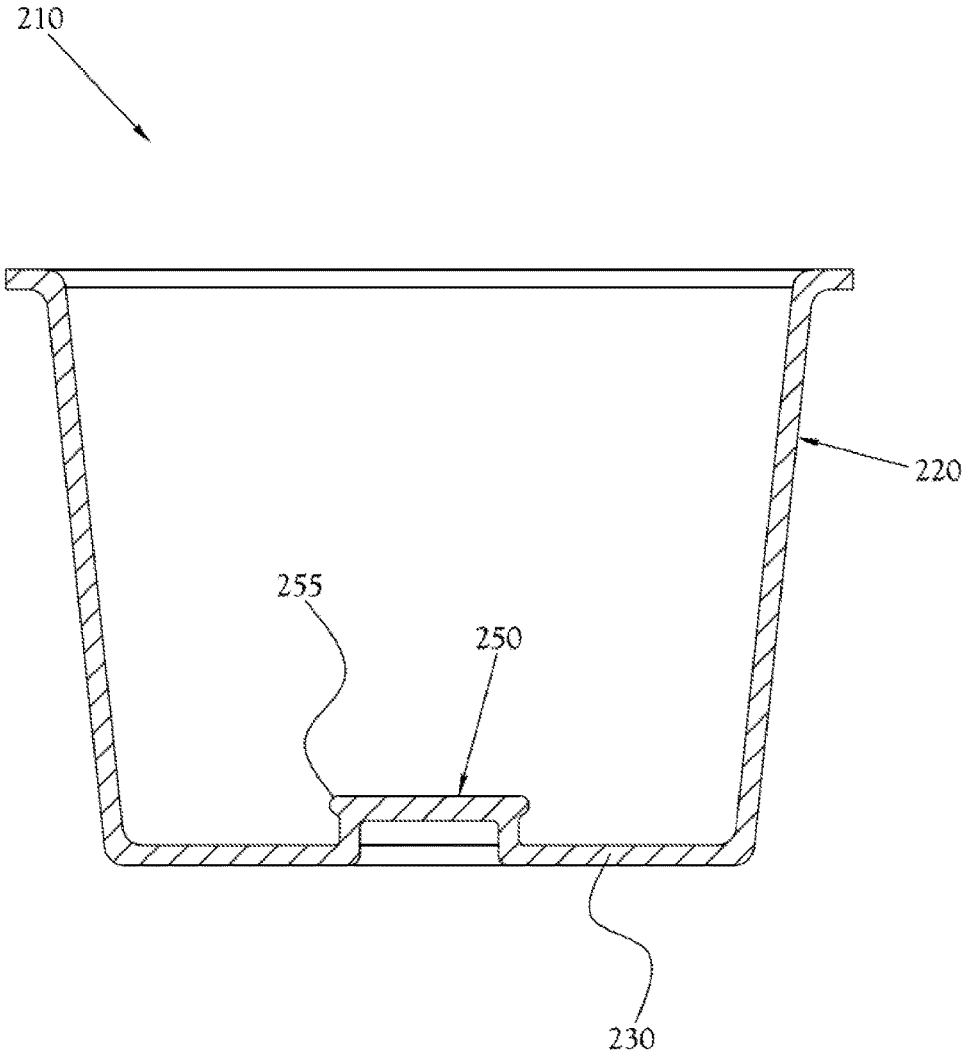
FIG. 8 is a midline cross-sectional view of the cup member of the embodiment of the segmented yogurt container illustrated in FIG. 7.
Figure 9:
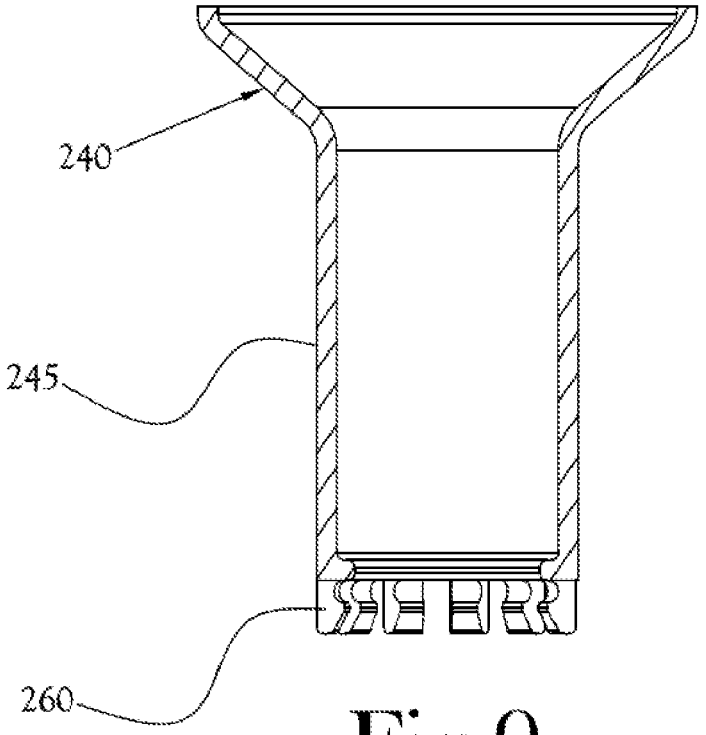
FIG. 9 is a midline cross-sectional view of the secondary container of the segmented yogurt container illustrated in FIG. 7.
Figure 10:
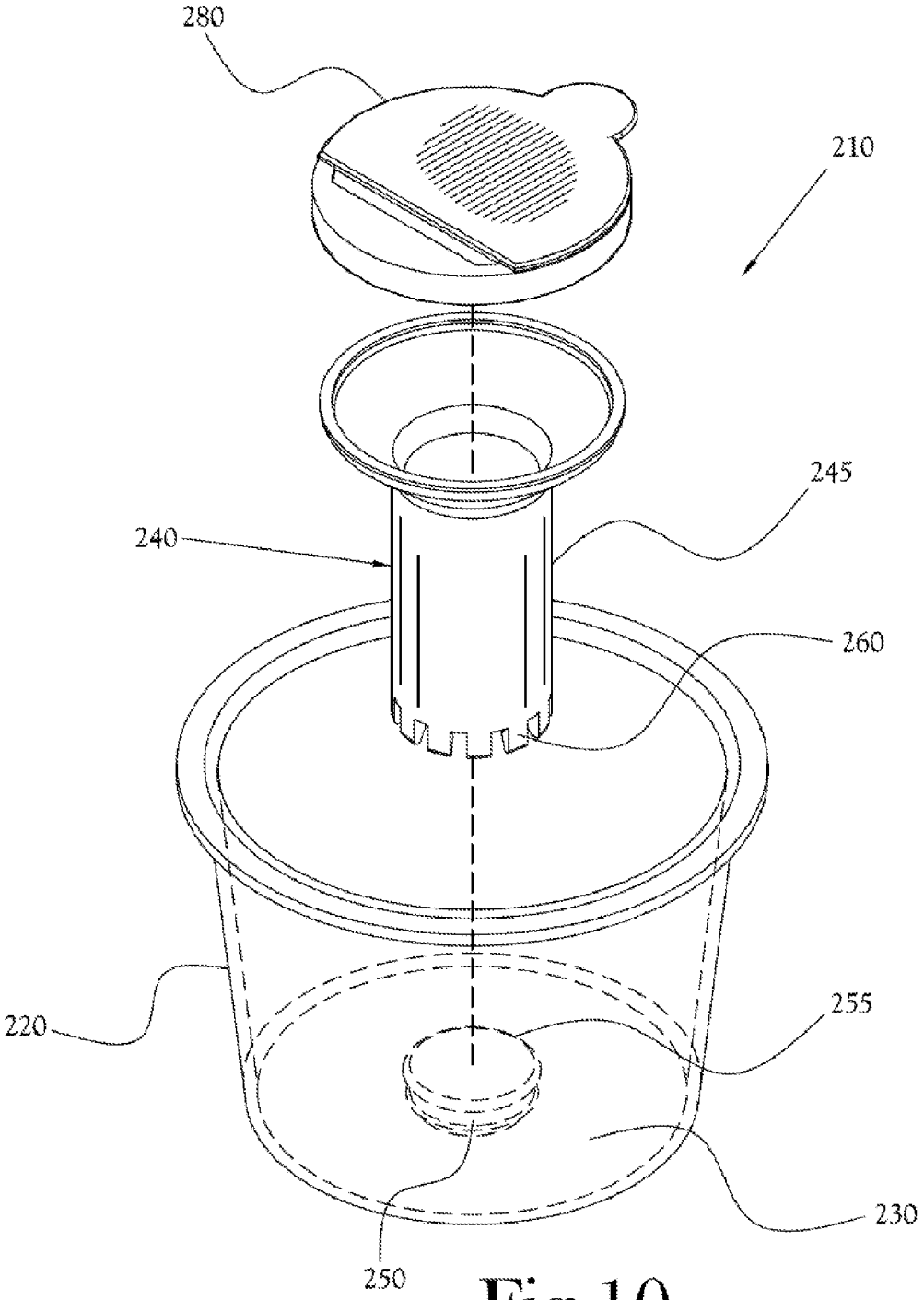
FIG. 10 is an exploded view of the segmented yogurt container illustrated in FIG. 7.
Figure 11:
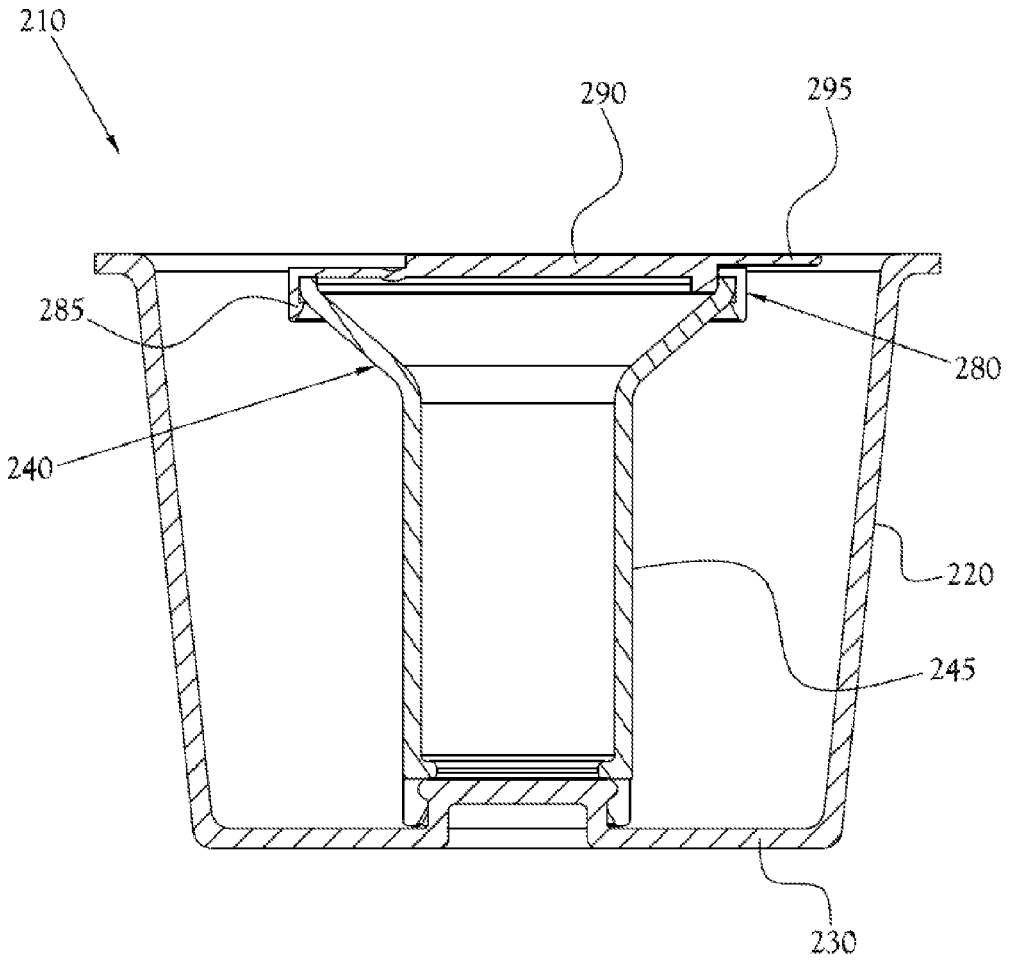
FIG. 11 is a midline cross-sectional view of the segmented yogurt container illustrated in FIG. 7.
Figure 12:
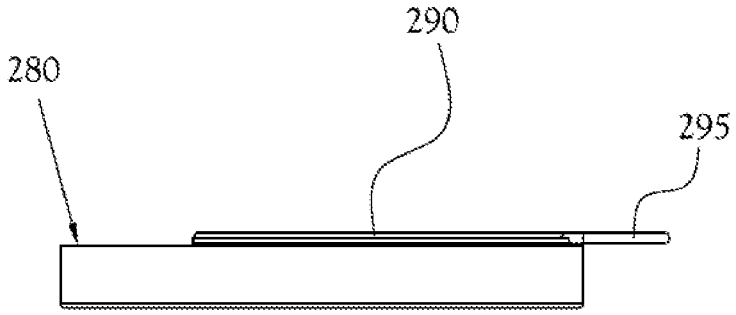
FIG. 12 is midline cross-sectional view of the snap-lid member of the secondary container of the embodiment of the segmented yogurt container illustrated in FIG. 7.
Figure 13:
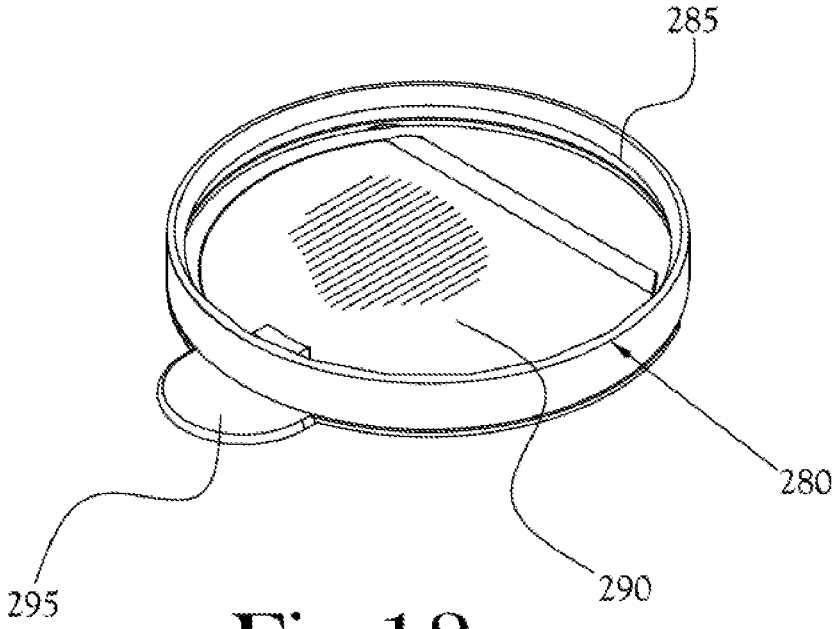
FIG. 13 is a perspective view of the snap-lid member illustrated in FIG. 14.

In accordance with a further exemplary embodiment, segmented yogurt container 110 includes a primary container, defined by cup member 120 having an open top 125, a closed base 130, and at least one wall member 135 extending upwardly from the closed base 130, and a secondary container 140. As illustrated in FIG. 6, secondary container 140 is defined by a cylinder 145 having two open ends, at least one end of which is internally threaded, defining a threaded end 148. An externally threaded boss 150 is disposed on, or carried by, the base 130 of cup member 20. When cylinder 145 is threaded onto threaded boss 150, boss 150 substantially seals the threaded end 148 of cylinder 145 such that cylinder 145 can then receive a secondary food product. FIG. 6 illustrates cylinder 145 threaded onto threaded boss 150 in a condition ready to receive the primary and secondary food items.

Referring to FIGS. 7-13, a further exemplary embodiment is described. In this regard, segmented food container 210 includes a primary container, defined by cup member 220, as described above, and a secondary container 240. A boss member 250 is disposed on, or carried by, the base 230 of cup member 220. Secondary container 240 is defined by a cylinder 45 having two open ends, at least one end of which is adapted to be received by and releasably secured to boss member 50. In this regard, the boss member 250 has an annular ridge member 255. Further, the lower end of the secondary container 240 is adapted with a plurality of annular detents 260 that are adapted to releasably engage the annular ridge member 255 so as to releasably secure the secondary container 240 to the boss member by means of a force fit. When cylinder 245 is snapped onto boss member 250, cylinder 245 is sealed from the interior of the cup member 220 such that cylinder 245 can then receive a secondary food product.

In a further embodiment, a snap-fit lid member 280 is used to seal the upper end of secondary container 240. In this regard, lid member 280 includes an interior annular ridge 285 that is adapted to snap over the flared upper end 246 of secondary container 240. Snap-fit lid member 280 further includes a selectively operable cover member 290 which can be opened by a consumer without the need to remove snap-fit lid member 280 from secondary container 240. Cover member 290 includes a tab 295 which is selectively engageable by a user for the purpose of opening cover member 290.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A segmented food product container having a removable secondary compartment for segregating a secondary food ingredient from a primary food ingredient prior to consumption, said segmented food product container comprising:

a cup member, said cup member having a base member, at least one wall member extending upwardly from said base member, and an open top, wherein said cup member is adapted to contain a primary food product without leaking;

a boss member carried by said base member;

an open-ended cylinder member having at least one end adapted to be releasably received by said boss member, said open-ended cylinder being adapted to receive a secondary food product, wherein said open-ended cylinder member includes a flared upper end, whereby said open-ended cylinder member defines a funnel member, wherein said flared upper end of said open-ended cylinder member further includes a textured outer surface adapted to assist with gripping said upper end of said open-ended cylinder member; and a lid member for releasably sealing said open top of said cup member and an upper end of said open-ended cylinder when said open-ended cylinder is releasably attached to said boss member.

2. The segmented food product container of claim 1 wherein said primary food product is yogurt.

3. The segmented food product container of claim 1 wherein said secondary food product is selected from a group consisting of spices, cardamom, cinnamon, nutmeg, black pepper, red pepper, habanero pepper, various varieties of chili peppers, coconut, cumin, cilantro, coriander, paprika, onion, tamarind, thyme, turmeric, ginger, fennel, mustard, mint, cloves, dates, capsicum, chives, curry leaves, garlic, anise, asafoetida, dill, gourd, and squash.

4. The segmented food product container of claim 1 wherein said boss member extends upwardly from said base member.

5. The segmented food product container of claim 1 wherein said boss member is threaded and said open-ended cylinder member has at least one threaded end adapted to be threadably received by said threaded boss member.

6. The segmented food product container of claim 5 wherein said open-ended cylinder member includes at least one internally threaded end adapted to be threadably received by said threaded boss member.

7. A segmented food product container having a removable secondary compartment for segregating a secondary food ingredient from a primary food ingredient prior to consumption, said segmented food product container comprising:

a cup member, said cup member having a base member, at least one wall member extending upwardly from said base member, and an open top, wherein said cup member is adapted to contain a primary food product without leaking;

a threaded boss member carried by said base member;

an open-ended cylinder member having at least one threaded end adapted to be threadably received by said threaded boss member and a flared upper end, whereby said open-ended cylinder member defines a funnel member, wherein said flared upper end of said open-ended cylinder member further includes a textured outer surface adapted to assist with gripping said upper end of said open-ended cylinder member, said open-ended cylinder being adapted to receive a secondary food product; and a lid member for releasably sealing said open top of said cup member and an upper end of said open-ended cylinder when said open-ended cylinder is threadably attached to said boss member.

8. The segmented food product container of claim 7 wherein said primary food product is yogurt.

9. The segmented food product container of claim 7 wherein said secondary food product is selected from a group consisting of spices, cardamom, cinnamon, nutmeg, black pepper, red pepper, habanero pepper, various varieties of chili peppers, coconut, cumin, cilantro, coriander, paprika, onion, tamarind, thyme, turmeric, ginger, fennel, mustard, mint, cloves, dates, capsicum, chives, curry leaves, garlic, anise, asafoetida, dill, gourd, and squash.

10. The segmented food product container of claim 7 wherein said threaded boss member extends upwardly from said base member.

11. The segmented food product container of claim 7 wherein said open-ended cylinder member includes at least one internally threaded end adapted to be threadably received by said threaded boss member.

* * * * *